United States Patent [19]

Roberts

[11] Patent Number: 4,821,031

[45] Date of Patent: Apr. 11, 1989

[54] IMAGE DISPLAY APPARATUS

[75] Inventor: Stephen J. Roberts, Herkimer, N.Y.

[73] Assignee: International Computers Limited, London, England

[21] Appl. No.: 146,219

[22] Filed: Jan. 20, 1988

[51] Int. Cl.[4] ..... G09G 1/16

[52] U.S. Cl. ..... 340/731

[58] Field of Search ..... 340/731, 723, 720

[56] References Cited

U.S. PATENT DOCUMENTS

| | | | |
|---|---|---|---|
| 4,087,808 | 5/1978 | Herndon, Jr. | 340/731 |
| 4,107,664 | 8/1978 | Marino | 340/731 |
| 4,314,244 | 2/1982 | Demke et al. | 340/731 |
| 4,356,482 | 10/1982 | Oguchi | 340/731 |
| 4,366,475 | 12/1982 | Kishi et al. | 340/731 |
| 4,546,349 | 10/1985 | Prohofsky et al. | 340/731 |
| 4,630,039 | 12/1986 | Shimada | 340/731 |
| 4,644,339 | 2/1987 | Ruder | 340/731 |
| 4,654,651 | 3/1987 | Kishi et al. | 340/731 |
| 4,754,270 | 6/1988 | Murauchi | 340/731 |

*Primary Examiner*—Gerald L. Brigance
*Assistant Examiner*—Richard Hjerpe
*Attorney, Agent, or Firm*—Lee & Smith

[57] ABSTRACT

Image display apparatus reads data from an image memory to produce an image on a interlaced raster-scanned display. The image can be zoomed by producing X and Y magnifications. X magnification is produced by repeating each pixel a predetermined number of times. Y magnification is produced by repeating each display line a predetermined number of times. The number of repetitions of each display line can be varied from line to line and can be different in the two frames, so as to cope with odd-number Y magnification factors. This is achieved by using a register file which holds the required line repetition counts.

7 Claims, 4 Drawing Sheets

IMAGE DISPLAY APPARATUS

FIELD OF THE INVENTION

This invention relates to image display apparatus of the kind in which an image is produced on a raster-scanned display device such as, for example, a cathode-ray tube (CRT).

BACKGROUND OF THE INVENTION

It is known to store data representing a digital image in a image memory, and then to read out the data in a predetermined sequence, in order to generate a stream of pixel (picture element) data for controlling the display.

In such a system, it may be desired to "zoom" the image i.e. to expand or contract it by a specified magnification factor. This requires magnifying the image in both the X (horizontal) and Y (vertical) directions.

One object of the present invention is to provide an image display apparatus with such a zoom facility.

A particular problem arises when the display device is of the interlaced type i.e. displaying alternate frames with the raster lines of the two frames interlaced with each other. In this case, it is difficult to produce Y magnification by an odd factor, as well as by an even factor.

Another object of the present invention is therefore to overcome this problem.

SUMMARY OF THE INVENTION

According to the invention, there is provided image display apparatus for producing a raster-scanned display comprising interlaced odd and even frames, the apparatus comprising (a) an image store for holding image data, (b) means for reading lines of image data from the image store, (c) register means for holding line repeat count values independently for each frame, (d) means operative in each said frame for selecting the respective line repeat count values for successive lines of image data, and (e) line repeat means for displaying each said line of image data a number of times as indicated by the currently selected line repeat count value, thereby producing a vertical magnification of the image.

One image display apparatus in accordance with the invention will now be described by way of example with reference to the accompanying drawings.

DESCRIPTION OF AN EMBODIMENT OF THE INVENTION

Figure 1:
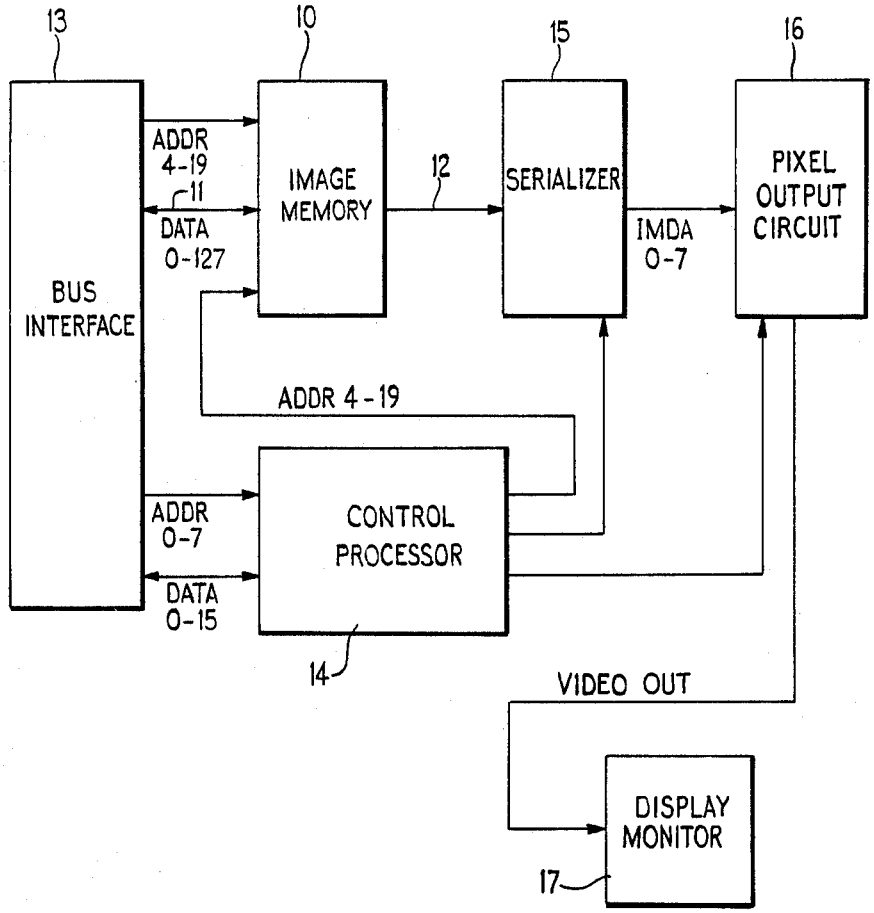
FIG. 1 is an overall block diagram of the image display apparatus.

Referring to FIG. 1, the image display apparatus includes an image memory 10, comprising a 1 Mbyte dynamic RAM, configured as 64K 128-bit words, each of which can be addressed individually for reading or writing.

The image memory 10 is a two-port memory, having a read/write port 11, and a read-only port 12, each of which is 128 bits wide. The read/write port 11 is connected to data lines DATA0–127 of a bus interface 13 which can, in turn, be connected to a host processor (not shown) so as to allow the host to read or write data in the image memory. The read only-port 12 is used for reading out data from the image memory for display.

The image memory 10 is addressed by a sixteen-bit address ADDR4–19, which comes either from the bus interface 13, or from a control processor 14. This address selects one of the 128-bit words in the image memory.

The read-only port 12 is connected to the input of a serializer circuit 15. This comprises a shift register which receives the 128-bit word from the memory, and then shifts it out eight bits at a time on a byte-wide output path IMDA0–7. When the shift register is empty, the serializer requests another 128-bit word to be fetched from the memory.

The output path IMDA0–7 is fed to a pixel output circuit 16, which converts each byte into a series of bits, each of which represents the display value of a pixel (black or white). When the eight bits of a byte have been shifted out, the pixel output circuit requests the serializer 15 to supply another byte.

The serial pixel data from the circuit 16 is supplied to a display monitor 17, which produces the required display.

The operation of the display apparatus is controlled by the control processor 14. This is connected to the address bit lines ADDR0–7 and data bit lines DATA-0–15 of the bus interface 13, so that it can communicate with the host processor.

As mentioned above, the control processor 14 produces an address which is used to address the image memory 10. This is used for reading out the image data in the required sequence for display. The control processor also produces control signals for the serializer and the pixel output circuit.

Figure 2:
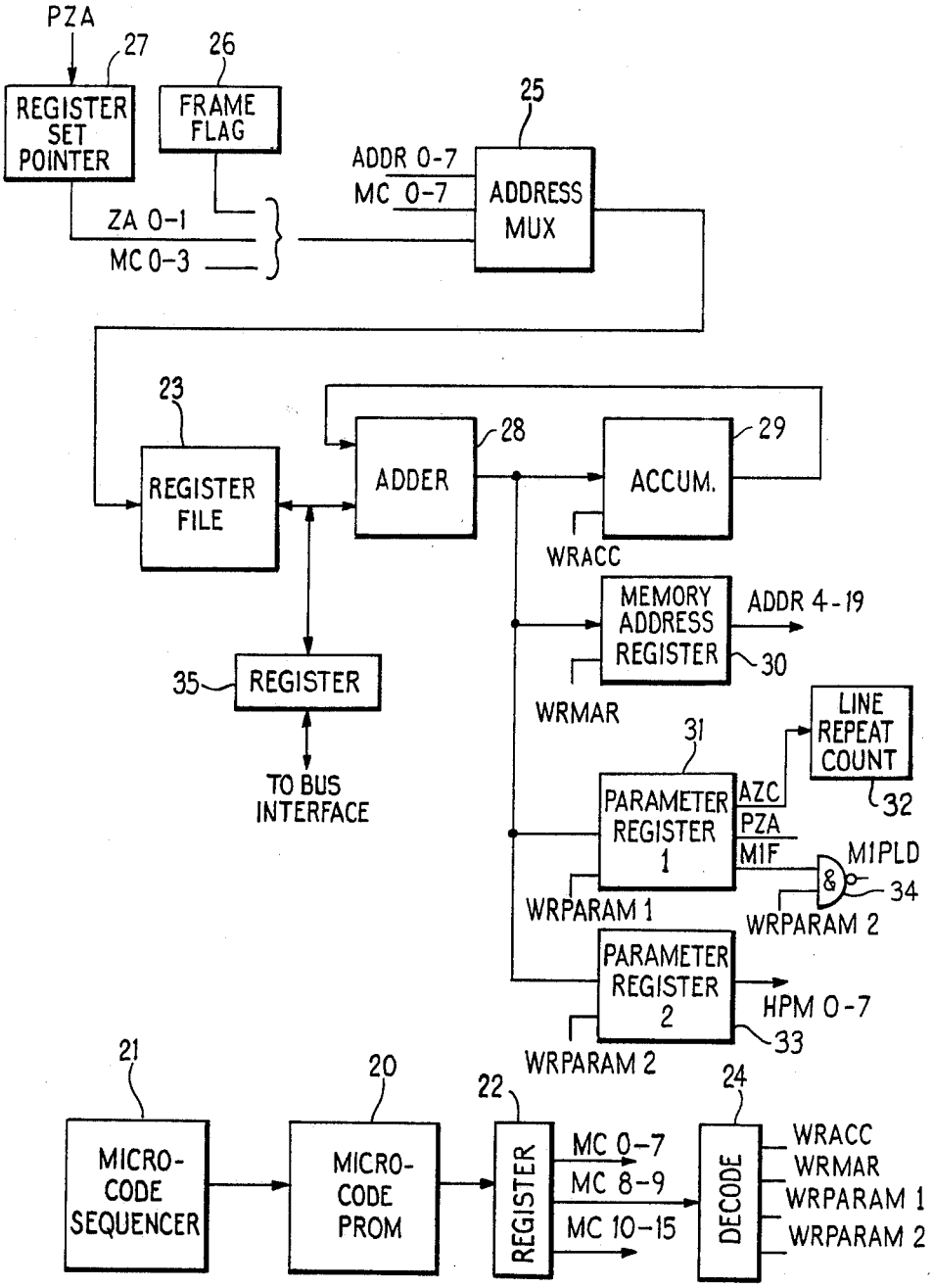
FIG. 2 is a block diagram of a control processor forming part of the apparatus.

The control processor is shown in more detail in FIG. 2.

Referring to FIG. 2, the control processor comprises a programmable read-only memory (PROM) 20, which holds microcode for the processor. The PROM is addressed by a sequence of addresses from a microcode sequencer 21. Each microinstruction read out of the PROM is held in a microcode register 22.

Each microinstruction comprises sixteen bits MC0–15. Bits MC0–7 represents a register file address which is used for addressing a register file 23. Bits MC8–9 are decoded in a decoder 24 to produce one of four register select signals WRACC, WRMAR, WRPARAM1 and WRPARAM2, which control the loading of four registers, as will be described. Bits MC10–15 provide control signals for the serializer and the pixel output circuit.

The register file 23 is a RAM, having 256 locations, each holding 16 bits. The register file is addressed by an eight-bit address, which is selected by a multiplexer 25 from one of three sources, as follows:

(1) ADDR0-7 from the bus inteface 13 (FIG. 1)

(2) MC0-7 from the microcode.

(3) A composite address, comprising bits FRAME, ZA0-1, and MC0-3. FRAME is obtained from a frame flag 26, and indicates which frame of the interlaced display is currently being scanned (FRAME=0 indicates an even frame, FRAME=1 indicates an odd frame). ZA0-1 is obtained from a register set pointer 27. As will be described, the bits FRAME and ZA0-1 together select one of eight sets of registers in the file, four sets for each frame. Each of these sets comprises eight individual registers, one of these registers being selected by the bits MC0-3 from the microcode.

The data output of the register file 23 is connected to one input of an adder 28. The output of the adder is connected to the inputs of four registers, as follows:

(1) An accumulator register 29. The output of this is connected to the other input of the adder 28.

(2) A memory address register 30. This provides the sixteen bit address ADDR4-19 from the control processor to the image memory 10.

(3) A first parameter register 31. This contains a four-bit field AZC, which represents an initial load value for a line repetition counter 32, a two-bit field PZA, which represents an initial preload value for the register set pointer 27, and a one-bit field which represents a magnification flag M1F.

(4) A second parameter register 33. This provides an 8-bit horizontal pixel modulus HPM0-7, which indicates the desired image magnification in the X-direction.

Writing of data from the output of the adder into these four registers is controlled by the respective signals WRACC, WRMAR, WRPARAM1 and WRPARAM2 from the decoder 24. WRPARAM2 also enables NAND gate 34, so as to gate out the magnification flag M1F from the register 31, to provide a control signal M1PLD.

The output of the register file 23 is also connected, by way of a bidirectional register 35 to the bus interface 13.

The line repetition counter 32 is used, as will be described, to control the number of times each display line is repeated, and hence controls the Y magnification of the image. For example, if each line is repeated three times, this produces a Y magnification factor of 3.

Figure 3:
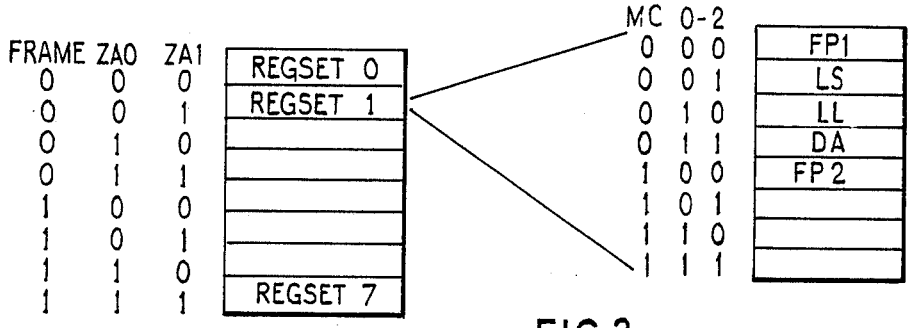
FIG. 3 is a diagram showing the layout of registers in a register file.

Referring now to FIG. 3, the register file 23 holds eight sets of registers REGSET0-7 , each set consisting of eight registers, i.e. locations in the register file.

During normal display of images, the register file is addressed by the third input of the multiplexer 25, i.e. by the composite address FRAME, ZA0-1, MC0-3.

The FRAME and ZA0-1 signals together select one of the eight register sets, as indicated in FIG. 3. Thus, during even frames (FRAME=0), the first four register sets REGSET0-3 are selected in turn by successive values of ZA0-1. During odd frames (FRAME=1), the last four register sets (REGSET 4-7) are selected.

The address bits MC0-3 from the microcode select one of the eight registers within the selected set, allowing this register to be accessed e.g. to be read out to the adder 28.

The eight registers in each set comprise the following:

(1) FP1: Vertical zoom control register. This register holds the values of the parameters AZC, PZA and M1F that are to be loaded into the first parameter register 31.

(2) LS: Line start register. This holds the address in the image memory of the first 128-bit word in the current display line.

(3) LL: Line length register. This contains a line length parameter equal to eight times the length of a display line in 128 bit words. For example, if each display line contains 16 words (i.e. 2048 pixels), then the line length parameter is equal to 2. This parameter is added to the line start register LS at the start of each new display line (i.e. after the required number of repeats of the previous display line), so as to produce the start address for the new line. The multiplier of 8 is required because, as will be described, a different one of the eight register sets is used for each new display line.

(4) DA: data address register. This contains the address of the next 128-bit word of image data to be read out of the image memory for display. This register is loaded with the line start address from the register LS during each horizontal blanking period of the display, and is then incremented by one each time a new 128-bit word is accessed.

(5) FP2: Line parameter register. This contains a value for the horizontal pixel modulus HPM0-7, for loading into the second parameter register 33. This modulus, in conjunction with the magnification flag M1F, specifies the required X magnification factor as follows:

| M1F | HPM | X Magnification |
|---|---|---|
| 0 | 0000 0001 | 1 |
| 1 | 0000 0001 | 2 |
| 1 | 0000 0011 | 3 |
| 1 | 0000 0111 | 4 |
| 1 | 0000 1111 | 5 |
| 1 | 0001 1111 | 6 |
| 1 | 0011 1111 | 7 |
| 1 | 0111 1111 | 8 |
| 1 | 1111 1111 | 9 |
| 1 | 1111 1110 | 10 |
| 1 | 1111 1100 | 11 |
| 1 | 1111 1000 | 12 |
| 1 | 1111 0000 | 13 |
| 1 | 1110 0000 | 14 |
| 1 | 1100 0000 | 15 |

As will be described, the X - magnification is produced by controlling the number of clock beats for which each pixel is displayed. For example, if a magnification factor of 3 is required, each pixel is displayed for 3 clock beats.

Figure 4:
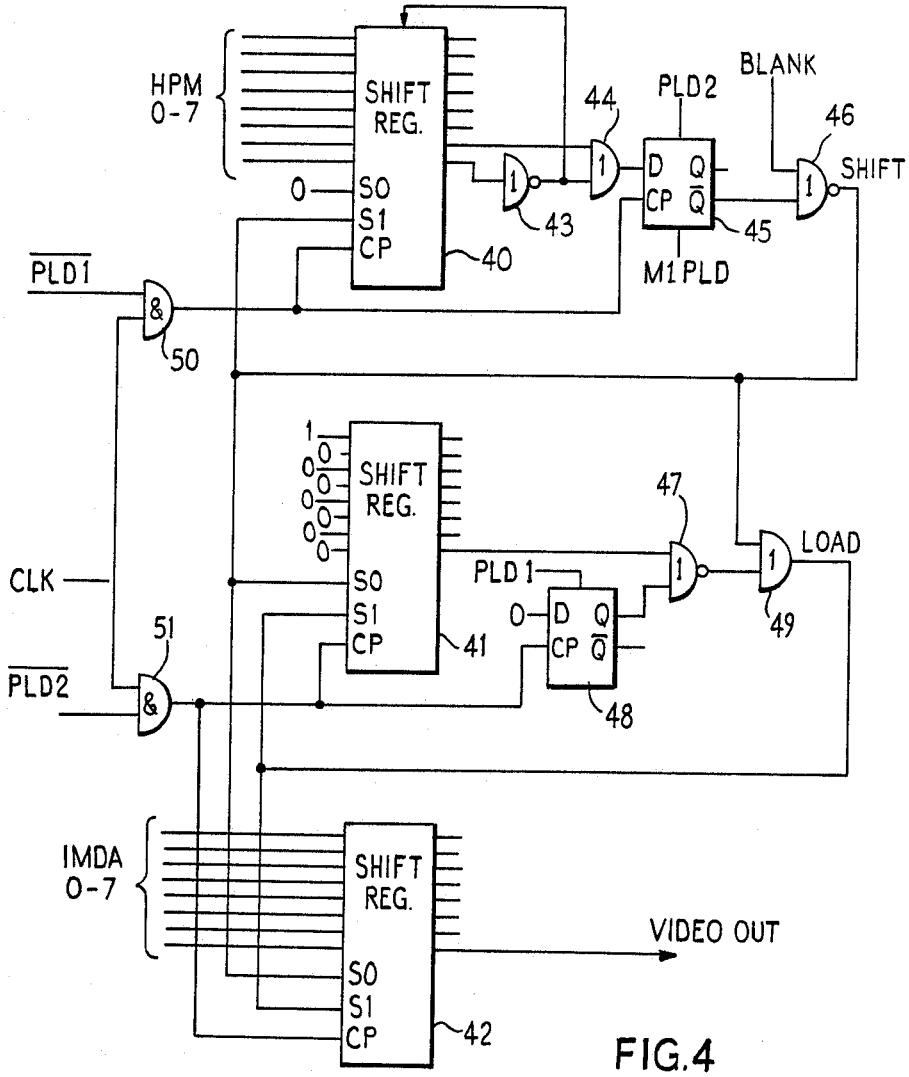
FIG. 4 is a logic diagram of pixel output logic forming part of the display apparatus.

Referring now to FIG. 4, this shows the pixel output circuit 16 in more detail.

The pixel output circuit comprises three eight-bit shift registers 40, 41, 42. Each of these registers has two control inputs S0 and S1 which select operation modes as follows:

| S0 | S1 | Mode |
|---|---|---|
| 0 | 0 | Load |
| 0 | 1 | Shift |
| 1 | 0 | Not used |
| 1 | 1 | Hold |

In the Load mode, a data byte is loaded into the register in parallel at each clock beat applied to its clock input CP. In the shift mode, the data is shifted downwards (as viewed in the drawing) by one bit position at each beat of the clock.

Shift register 40 receives at its parallel input the horizontal pixel modulus HPM0-7 from the second parameter register 33. The output from the last stage of this shift register is inverted by a gate 43 and fed back to the first stage, so that the shift register 40 performs a circular shift on data held in it, with inversion of each bit fed back. The output of the gate 43 is also combined in an OR gate 44 with the output of the second last stage of the shift register. Thus, the output of the OR gate 44 is low only if the last two stages of the shift register contain the bits 01. As will be shown, this condition indicates that the current pixel has been displayed for the required number of clock beats, and that the next pixel should now be output.

The output of the OR gate 44 is fed to the data input of a flip-flop 45. The inverse output of this flip-flop is combined in a NOR gate 46 with a BLANK signal which indicates a horizontal or vertical blanking period for the display. The output of the NOR gate 46 provides a SHIFT signal which is fed to the S1 input of shift register 40 and to the SO inputs of shift registers 41 and 42. Thus, when SHIFT is low, a new byte is loaded in parallel into shift register 40, and one bit is shifted serially out of each of the registers 41, 42 at each clock beat.

The shift register 41 receives a fixed input pattern 1000 0000. This pattern is shifted through the register 41 so that, after seven shifts, a one will appear at the output of the last stage. This last stage is connected to one input of a NOR gate 47, the other input of which is connected to the output of a flip-flop 48. The output of the NOR gate 47 is combined in an OR gate 49 with the SHIFT signal, to produce a LOAD signal. LOAD is applied to the S1 input of registers 41 and 42 so that, when LOAD is low, data is loaded in parallel into both these registers at the clock beat.

Shift register 42 has its parallel data input connected to receive the image data byte IMDA0-7 from the serializer 15. The serial output of register 42 provides the VIDEO OUT signal to the monitor 17.

The pixel output circuit is driven by a 158.43 MHz clock signal CLK from a crystal oscillator. This signal is combined in AND gates 50, 51 with the inverses of two preload signals PLD1 and PLD2. The output of AND gate 50 is connected to the clock inputs of shift register 40 and flip-flop 45. The output of AND gate 51 is connected to the clock inputs of shift registers 41, 42 and the flip-flop 48.

The preload signals PLD1 and PLD2 are also connected respectively to the preset inputs of the flip-flops 48 and 45. The reset input of flip-flop 45 receives the signal M1PLD from the NAND gate 34. (FIG. 2).

The operation of the pixel output circuit is as follows:

During each blanking period, PLD1 is produced, which sets the flip-flop 48, making LOAD low. This causes the fixed bit pattern to be loaded into shift register 41 and the image data to be loaded into the register 42. The flip-flop 48 is unset again at the next clock beat.

PLD2 is then produced. Assuming for the moment that M1PLD is low, PLD2 sets the flip-flop 45. Since BLANK is high, SHIFT is low, and hence the shift register 40 is loaded with the horizontal pixel modulus HPM at the next clock beat.

During linescan, the shift register 40 is shifted circularly, by way of the inverter gate 43, at each clock beat. This continues until the pattern 01 is detected in the last two stages of this shift register, whereupon flip-flop 45 is unset, causing SHIFT to go low. This causes the shift registers 41, 42 to be shifted one bit position, so as to shift out one bit of pixel data. At the same time, the horizontal pixel modulus HPM is re-loaded into shift register 40.

Thus, it can be seen that the shift register 40 counts the required number of clock beats for each pixel, as specified by HPM.

For example, suppose HPM is equal to 0000 0111, representing an X magnification factor of 4.

It can be seen that, at successsive clock beats, the shift register 40 will contain the following data:

| |
|---|
| 0000 0111 |
| 0000 0011 |
| 0000 0001 |

Thus at the second clock beat after loading, the pattern 01 will be detected in the last two stages of the shift register. Hence, the flip-flop 45 is set at the third beat. This puts SHIFT low, so that at the fourth clock beat a pixel data bit is shifted out of shift register 42, while the shift register 40 is reloaded with HPM. Hence, it can be seen that, in this case, one pixel data is shifted out every four clock beats, giving the required X magnification factor.

The operation is similar for all the possible X magnification factors, except for the factor 1, which is treated as a special case. As mentioned above, this case is indicated by the flag M1F=0, which causes M1PLD to go high whenever the parameter register 33 is loaded. The signal M1PLD prevents the flip-flop 40 from being preset by PLD2. Hence, the SHIFT will already be low at the start of the linescan, so that a pixel data bit is shifted out at the first clock beat, and at each subsequent beat.

The above cycle is repeated, so as to shift out all eight pixel data bits from the shift register 42. The output of the last stage of shift register 41 will then go high, causing LOAD to go low. A new data byte will then be loaded into the shift register 42, while at the same time the shift register 41 is re-set to its initial value. Thus, it can be seen that the shift register 41 acts as a counter for counting the number of pixel data bits, so as to reload the shift register 42 when it becomes empty.

Figure 5:
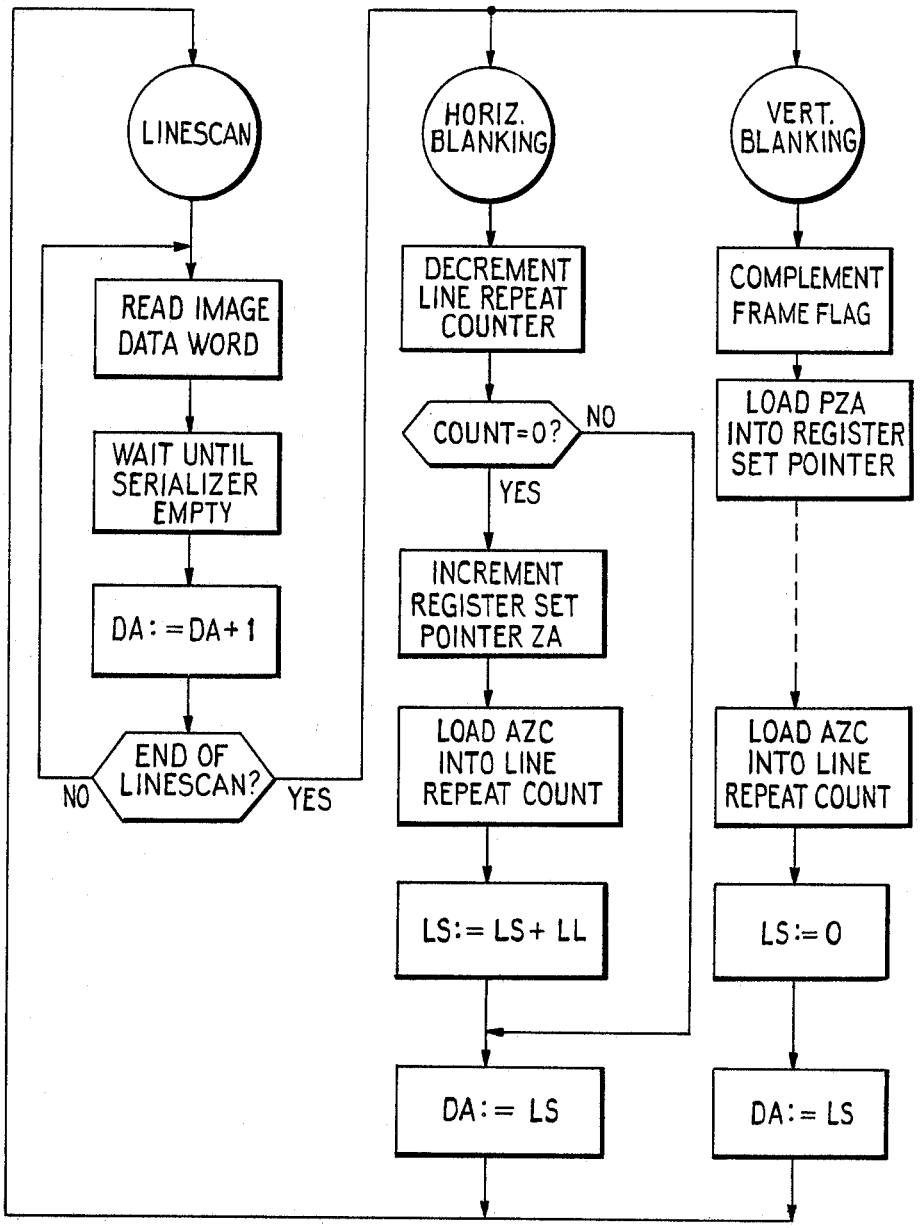
FIG. 5 is a flow chart illustrating the operation of the control processor.

Referring now to FIG. 5, this shows a flow chart of the operation of the control processor, as determined by its microcode.

At the start of the linescan, the processor addresses the register file 23, using the composite address FLAG, ZA0-1, MC0-3, to obtain the value of the data address register DA of the current register set. DA is then used to address the image memory, so as to read out a 128-bit word to the serializer 15 for display.

When this word has been shifted out of the serializer 15, the processor then increments the register DA by one, and accesses the image memory again to obtain the next 128-bit word. This is repeated for each subsequent word, until the end of the linescan.

During the horizontal blanking period, the processor decrements the line repeat counter 32 by one. If this count is now zero, the register set pointer 27 is incremented, so as to select a new register set. The vertical zoom control register FP1 of this new set is then accessed to obtain the parameter AZC, which is loaded into the line repeat counter 32 by way of the first parameter register 31, so as to re-initialise the line repeat count. The processor also accesses the line start register LS and line length register LL, adds them together, and places the result back in LS. This updates the line start address so that it now points to the next line of image data.

The contents of the line start register LS are then copied into the data address register DA, so as to initialise it.

During the vertical blanking period, the FRAME flag is complemented, so that it indicates that the other frame is now being displayed. The register FP1 is accessed, to obtain the parameter PZA, which is loaded into the register set pointer 27 so as to re-initialise it. Other actions are performed as for the horizontal blanking period. As indicated by the broken line, further tasks not relevant to the present invention may also be performed in the vertical blanking period.

It can be seen that each line of image data is repeated a number of times as determined by the parameter AZC from the vertical zoom control register FP1. This produces the required Y magnification.

For example in order to produce a Y magnification of 3, the registers are given the following values:

| Frame | Register Set | Line | AZC |
|---|---|---|---|
| 0 | 0 | 1 | 2 |
| 0 | 1 | 2 | 1 |
| 0 | 2 | 3 | 2 |
| 0 | 3 | 4 | 1 |
| 1 | 4 | 1 | 1 |
| 1 | 5 | 2 | 2 |
| 1 | 6 | 3 | 1 |
| 1 | 7 | 4 | 2 |

It can be seen that Line 1 is repeated 3 times: twice in frame 0 and once in frame 1. Similarly, line 2 is repeated once in frame 0 and twice in frame 1, and so on. This gives the required Y magnification factor.

It should be noted that the system is able to cope with the interlaced nature of the display by allowing scan lines to be repeated different numbers of times in the two frames. This is necessary in the case of odd magnification factors.

I claim:

1. Image display apparatus for producing a raster-scanned display comprising interlaced odd and even frames, the apparatus comprising:

(a) an image store for holding image data, (b) reading means for reading lines of image data from the image store, and displaying those lines to produce an image, (c) first register means for holding line repeat count values for the odd frames, (d) second register means for holding line repeat count values for the even frames, (e) selection means operative in each odd frame, for selecting line repeat count values from the first register means, and operative in each even frame, for selecting line repeat count values from the second register means, and (f) line repeat means, coupled to said reading means, for causing each line of image data to be repeated a number of times as indicated by the line repeat count value currently selected by the selection means, thereby producing a vertical magnification of the image.

2. Apparatus according to claim 1 wherein the first and second register means comprise a plurality of registers and means for selecting successive registers within the selected group first or second register means for successive lines of image data.

3. Apparatus according to claim 1 wherein the line repeat means comprises:

(a) a counter, (b) means operative during each horizontal blanking period of the display for decrementing the counter, and (c) means operative when the counter reaches a terminal value for reading a next line of image data from the image store, and loading the counter with the currently selected line repeat count values.

4. Apparatus according to claim 1 further including output means for serializing the image data read from the image store, to produce a serial pixel data stream.

5. Apparatus according to claim 4 further including means for varying the data rate of said serial pixel data stream, whereby varying the horizontal magnification of the image.

6. Apparatus according to claim 5 wherein the means for varying the data rate comprises:

(a) means for generating a clock signal, (b) means for counting a variable number of beats of said clock signal, and (c) means for outputting data representing a pixel to said serial pixel data stream each time said number of beats has been counted.

7. Image display apparatus for producing an image on a raster-scanned display comprising interlaced odd and even frames, the apparatus comprising:

(a) an image store for holding image data, (b) reading means for reading a line of image data from the image store, (c) first and second groups of control registers, each of which holds a plurality of line repeat count values, (d) means for selecting the first group of registers during even frames, and for selecting the second group of registers during odd frames, (e) means for selecting in turn each of the line repeat count values within the selected group of registers, and (f) line repeat means coupled to said reading means for utilizing the selected line repeat count value to control the number of times said line of image data is read from the image store.

* * * * *